US008709959B2

(12) United States Patent
MacDonald et al.

(10) Patent No.: US 8,709,959 B2
(45) Date of Patent: Apr. 29, 2014

(54) PUNCTURE RESISTANT FABRIC

(75) Inventors: John Gavin MacDonald, Decatur, GA (US); Russell F. Ross, Atlanta, GA (US); JinHo Ryu, SuWon-si (KR)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 681 days.

(21) Appl. No.: 12/647,613

(22) Filed: Dec. 28, 2009

(65) Prior Publication Data

US 2011/0159759 A1 Jun. 30, 2011

(51) Int. Cl.
*B32B 27/12* (2006.01)

(52) U.S. Cl.
USPC ..... 442/157; 428/266

(58) Field of Classification Search
USPC ..... 442/59–180, 327–417
See application file for complete search history.

(56) References Cited

U.S. PATENT DOCUMENTS

| | | | | |
|---|---|---|---|---|
| 5,087,499 | A | 2/1992 | Sullivan | |
| 5,200,263 | A | 4/1993 | Gould et al. | |
| 5,368,930 | A | 11/1994 | Samples | |
| 5,407,612 | A | 4/1995 | Gould et al. | |
| 5,514,241 | A | 5/1996 | Gould et al. | |
| 5,529,837 | A | 6/1996 | Fujiki et al. | |
| 5,776,839 | A | 7/1998 | Dischler et al. | |
| 5,817,433 | A | 10/1998 | Darras | |
| 5,993,935 | A * | 11/1999 | Rasmussen et al. | 428/120 |
| 6,020,057 | A | 2/2000 | Darras | |
| 6,080,474 | A | 6/2000 | Oakley et al. | |
| 6,544,644 | B1 * | 4/2003 | Bouquerel et al. | 428/364 |
| 6,667,424 | B1 * | 12/2003 | Hamilton et al. | 604/375 |
| 6,800,331 | B2 * | 10/2004 | Bilyk et al. | 427/387 |
| 6,893,989 | B2 | 5/2005 | Breukers | |
| 7,226,878 | B2 | 6/2007 | Wagner et al. | |
| 7,498,276 | B2 | 3/2009 | Wagner et al. | |
| 7,582,343 | B1 | 9/2009 | Johnson | |
| 2003/0194504 | A1 * | 10/2003 | Bilyk et al. | 427/458 |
| 2005/0053642 | A1 * | 3/2005 | Ulbricht et al. | 424/443 |

FOREIGN PATENT DOCUMENTS

| | | | |
|---|---|---|---|
| EP | 0 170 981 | A1 | 2/1986 |
| JP | 2006-124866 | A | 5/2006 |
| WO | WO 95/32857 | A1 | 12/1995 |
| WO | WO 99/018156 | A1 | 4/1999 |
| WO | WO 01/29299 | A2 | 4/2001 |
| WO | WO 2009/011944 | A2 | 1/2009 |

OTHER PUBLICATIONS

Chellamuthu, Manojkumar et al., "Extensional Rheology of Shear-Thickening Nanoparticle Suspensions," *Soft Matter,* V. 5, 2009, pp. 2117-2124.

Hamamoto, A. et al., "Shear Viscosity of Concentrated Spherical Silica Suspension—Effect of Polymethylsiloxane Surface Treatment," Abstract of paper published in the Japanese Society of Cosmetic Chemists (SCCJ), vol. 39, No. 4, 2005, *International Journal of Cosmetic Science,* vol. 28, No. 2, 2006, p. 151.

(Continued)

*Primary Examiner* — D. Lawrence Tarazano
*Assistant Examiner* — Klee S Simmons

(57) ABSTRACT

The present invention is generally directed to a nonwoven fabric having a plurality of coated fibers, the coating including silane and dialdehyde, and, in certain embodiments, further including particles.

20 Claims, 2 Drawing Sheets

(56) References Cited

OTHER PUBLICATIONS

Huang, Kuan-Yeh et al., "Preparation and Anticorrosive Properties of Hybrid Coatings Based on Epoxy-Silica Hybrid Materials," *Journal of Applied Polymer Science,* vol. 112, No. 4, 2009, pp. 1993-1942.

Kamibayashi, Masashi et al., "Shear-Thickening Flow of Nanoparticle Suspensions Flocculated by Polymer Bridging," *Journal of Colloid and Interface Science,* vol. 321, No. 2, 2008, pp. 294-301.

Lin, J.C., "Investigation of Impact Behavior of Various Silica-Reinforced Polymeric Matrix Nanocomposites," *Composite Structures,* vol. 84, No. 2, 2008, pp. 125-131.

Zhang, Yang et al., "Preparation of Nanosilica Reinforced Waterborne Silylated Polyether Adhesive With High Shear Strength," *Journal of Applied Polymer Science,* vol. 109, No. 4, 2008, pp. 2434-2441.

* cited by examiner

PUNCTURE RESISTANT FABRIC

BACKGROUND OF THE INVENTION

Woven and nonwoven fabrics are useful in a wide variety of industrial, medical, and home environments where the fabrics may be subjected to sharp objects which can cut or penetrate the fabric. Nonwoven fabrics or webs are cost-advantaged in many of these applications. As used herein, the term "nonwoven fabric or web" generally refers to a web having a structure of individual fibers or threads which are interlaid, but not in an identifiable manner as in a knitted fabric. Examples of suitable nonwoven fabrics or webs include, but are not limited to, meltblown webs, spunbond webs, carded webs, etc. The basis weight of the nonwoven web may generally vary, such as from about 0.1 grams per square meter ("gsm") to about 120 gsm or more.

In particular, a variety of protective garments may be formed from woven and nonwoven fabrics such as coveralls, gowns, gloves and protective sleeves. While such garments may offer protection from fluids and bacteria, it would be an additional benefit if such garments could also reduce the incidents of sharps injuries to the wearer from cuts and punctures. It would also be beneficial if these garments maintained their breathability, drapability and comfort.

In medical environments, nonwoven fabrics are also utilized in products such as sheets, drapes and sterilization wrap which is utilized to protect surgical instruments, etc. Specifically, a nonwoven laminate such as a spunbond-meltblown-spunbond (SMS) laminate may be useful and cost-effective in wrapping medical instruments for sterilization and storage. SMS laminates generally include nonwoven outer layers of spunbonded polyolefins and an inner barrier layer of meltblown polyolefin. As used herein, the term "meltblown web" generally refers to a nonwoven web that is formed by a process in which a molten thermoplastic material is extruded through a plurality of fine, usually circular, die capillaries as molten fibers into converging high velocity gas (e.g. air) streams that attenuate the fibers of molten thermoplastic material to reduce their diameter, which may be to microfiber diameter. Thereafter, the meltblown fibers are carried by the high velocity gas stream and are deposited on a collecting surface to form a web of randomly dispersed meltblown fibers. Generally speaking, meltblown fibers may be microfibers that are substantially continuous or discontinuous, generally smaller than 10 microns in diameter, and generally tacky when deposited onto a collecting surface. As used herein, the term "spunbond web" generally refers to a web containing small diameter substantially continuous fibers. The fibers are formed by extruding a molten thermoplastic material from a plurality of fine, usually circular, capillaries of a spinnerette with the diameter of the extruded fibers then being rapidly reduced as by, for example, eductive drawing and/or other well-known spunbonding mechanisms. The production of spunbond webs is widely known. Spunbond fibers are generally not tacky when they are deposited onto a collecting surface and may have diameters less than about 40 microns, and are often between about 5 to about 20 microns.

The wrapped medical instruments may be subjected to sterilization and stored in environments where the protective sterilization wrap may fail due to tears, holes or cuts from the contents of the sterilization wrap or by collision or abrasion caused by external objects. These tears, holes or cuts may create a breach in the fabric which renders the medical instruments unusable. While SMS and other nonwoven fabrics may be relatively durable and inhibit the strikethrough of fluids or the penetration of bacteria, their ability to provide adequate durability and cut resistance could be improved.

Hence, there is a need for a fabric that can reduce or eliminate tears, holes or cuts while maintaining the comfort, breathability, drapability and cost effectiveness of the original material.

SUMMARY OF THE INVENTION

In accordance with one embodiment of the present invention, a nonwoven fabric includes a plurality of coated fibers, each coated fiber being formed from a fiber having an exterior surface and a coating composition disposed on at least a portion of the exterior surface of the fiber. In certain embodiments, at least about 50% of the visible exterior surface of the fiber is coated with the coating composition. In some embodiments, at least about 75% and, in particular embodiments, at least about 90% of the visible exterior surface of the fiber may be coated with the coating composition. The fibers may also be corona treated to enhance application of the coating to the fibers.

In certain embodiments, the coating includes an aminofunctionalized silane and a dialdehyde such as glutaraldehyde, wherein the weight percent of dialdehyde is greater than the weight percent of silane. In certain embodiments, the weight percent of dialdehyde is at least twice the weight percent of silane, and may be at least four times the weight percent of silane in the coating composition. In particular embodiments, aminopropyltriethoxysilane (APTES) or hexamethyldisilazane (HDMS) may be utilized as the silane, although other aminofunctionalized silanes are also suitable.

In selected embodiments, the fabric is air permeable or breathable and may be formed from any of a variety of materials and processes. In selected embodiments, the nonwoven fabric may be a laminate that includes a spunbond layer and a meltblown layer.

The application of the coating to the nonwoven fabric may increase the average puncture resistance of the fabric by at least about 10% and, in certain embodiments, may increase the average puncture resistance of the fabric by at least about 25%.

In accordance with another embodiment of the present invention, a nonwoven fabric may include a plurality of coated fibers, the coating including a plurality of particles, silane and dialdehyde such as glutaraldehyde, the weight percent of the dialdehyde in the coating being greater than the weight percent of silane. In particular embodiments, the weight percent of dialdehyde is at least about twice the weight percent of silane in the coating composition. In selected embodiments, the weight percent of dialdehyde is at least about twice the weight percent of particles in the coating composition. Any of a variety of silanes and dialdehydes may be utilized in these embodiments. The particles may be silica, titanium dioxide, alumina or any one of a variety of other particles. While the size of the particles may vary greatly, the particles are preferably nanoparticles having an average particle size of less than about 250 nanometers or, in selected embodiments, less than about 150 nanometers.

The application of the coating having particles to the nonwoven fabric may increase the average puncture resistance of the fabric by at least about 10% and, in certain embodiments, may increase the average puncture resistance of the fabric by at least about 20% or more.

The present invention additionally includes a method of coating a fibrous material which includes the steps of preparing a coating composition by mixing about one part by weight particles with at least about 0.25 parts by weight silane, at least about 4 parts by weight dialdehyde and a solvent. Various solvents may be used in the present invention, such as ethanol, propanol and mixtures of ethanol or propanol with water. In particular embodiments, the method may further include the steps of combining the silane and dialdehyde, and then adding the particles to the silane and dialdehyde mixture. A nonwoven fibrous material is provided and the coating composition is applied to the fibrous material to increase the basis weight of the fibrous material by about 0.5 gsm to about 6 gsm, although other ranges of coating levels may also be appropriate in selected embodiments.

The method of the present invention may also include the step of subjecting the nonwoven fibrous material to corona treatment. In certain embodiments, the fibrous material includes a plurality of fibers and wherein the coating composition covers at least about 75% of the exterior surface of a plurality of the fibers. In these and other embodiments, the breathability of the coated nonwoven fibrous material may be at least about 90% of the breathability of the uncoated nonwoven fibrous material.

Other features and aspects of the present invention are described in more detail below.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended figures in which.

Figure 1:
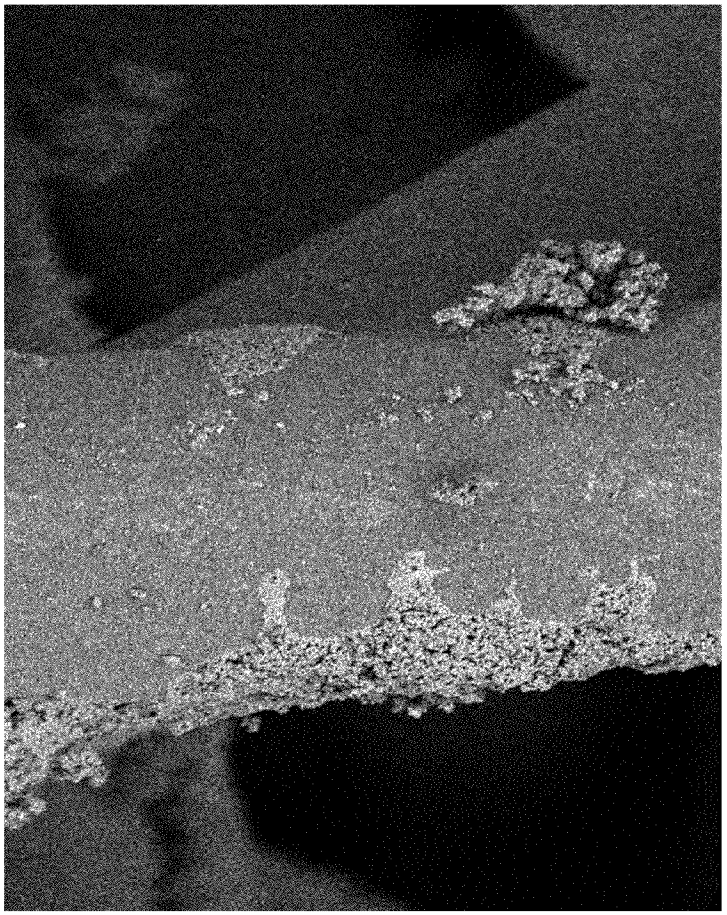
FIG. 1 is a photomicrograph of a coated fiber formed in accordance with an embodiment of the present invention.

Repeat use of reference characters in the present specification and drawings is intended to represent same or analogous features or elements of the invention.

DETAILED DESCRIPTION OF REPRESENTATIVE EMBODIMENTS

Reference now will be made in detail to various embodiments of the invention, one or more examples of which are set forth below. Each example is provided by way of explanation, not limitation of the invention. In fact, it will be apparent to those skilled in the art that various modifications and variations may be made in the present invention without departing from the scope or spirit of the invention. For instance, features illustrated or described as part of one embodiment may be used on another embodiment to yield a still further embodiment. Thus, it is intended that the present invention cover such modifications and variations.

The present invention is generally directed to a fabric having a coating which improves the average puncture resistance of the fabric, such as a nonwoven material, while maintaining the breathability of the fabric. In general, the coating may include silane and dialdehyde. In selected embodiments, the coating may include silane, dialdehyde and nanoparticles.

Many silanes are also suitable for use in the present invention, such as, for example, tetraethoxysilane (TEOS) which has the formula $Si(OC_2H_5)_4$. TEOS can be used as a crosslinking agent in silicone polymers. 2-aminopropyltriethoxysilane ("APTES") is an aminofunctional organosilane which is also suitable for use in the present invention. APTES provides superior bonds between inorganic substrates and organic polymers, and is represented by the chemical formula $NH_2CH_2CH_2CH_2Si(OC_2H_5)_3$. Hexamethyldisilazane (HMDS) is a chemical compound with the formula $HN[Si(CH_3)_3]_2$. Other aminofunctional silanes include hexamethylsilazane and heptamethyldisilazane. Other suitable compounds include 3-aminopropyltriethoxysilane, bis[(3-triethoxysilyl)propyl]amine, 3-aminopropyltrimethoxysilane, 3-aminopropylmethyldiethoxysilane, 3-aminopropylmethyldimethoxysilane, aminoethylaminopropyltrimethoxysilane, aminoethylaminopropyltriethoxysilane, aminoethylaminopropylmethyldimethoxysilane, aminoethylaminopropylmethyldiethoxysilane, aminoethylaminomethyltriethoxysilane, aminoethylaminomethylmethyldiethoxysilane, diethylenetriaminopropyltrimethoxysilane, diethylenetriaminopropyltriethoxysilane, diethylenetriaminopropylmethyldimethoxysilane, diethylenetriaminopropylmethyldiethoxysilane, diethylenetriaminomethylmethyldiethoxysilane, (n-phenylamino)methyltrimethoxysilane, (n-phenylamino)methyltriethoxysilane, (n-phenylamino)methylmethyldimethoxysilane, (n-phenylamino)methylmethyldiethoxysilane, 3-(n-phenylamino)propyltrimethoxysilane, 3-(n-phenylamino)propyltriethoxysilane, 3-(n-phenylamino)propylmethyldimethoxysilane, 3-(n-phenylamino)propylmethyldiethoxysilane, diethylaminomethyltriethoxysilane, diethylaminomethyldiethoxysilane, diethylaminomethyltrimethoxysilane, diethylaminopropyltrimethoxysilane, diethylaminopropylmethyldimethoxysilane, diethylaminopropylmethyldiethoxysilane and n-(n-butyl)-3-aminopropyltrimethoxysilane.

A dialdehyde compound is also used in the coating composition, and can be selected from alkyl or aromatic dialdehydes such as ethanedial (also known as glyoxal), butanedial (also known as succinaldehyde), pentanedial (also known as glutaraldehyde), and 1-4 benzenedicarboxaldehyde (also known as phthalic dicarboxaldehyde). Glutaraldehyde was selected as the dialdehyde compound to be utilized in the examples of the present invention. Glutaraldehyde is a colorless liquid with a pungent odor that has many uses such as crosslinking. In selected examples of the present invention, glutaraldehyde reacts with the silane to form a matrix. Glutaraldehyde was obtained from the Sigma-Aldrich Chemical Company (Milwaukee Wis.) and was used for each of the examples in Table 1.

In some embodiments, particles such as nanoparticles may be added to the silane and dialdehyde at any time during the mixing process. As used herein, the term "nanoparticles" may include particles having an average diameter of less than about 1000 nanometers, although it is to be understood that larger particles may be useful in particular embodiments of the present invention. The size of the nanoparticles will impact the ability of the nanoparticle to be adequately incorporated into the matrix of the coating. Although the size of the nanoparticles may be varied widely, the nanoparticle should be sufficiently small to enable its incorporation into the silane/dialdehyde network. For some embodiments, the nanoparticles may have an average diameter of are less than about 500 nm, and in other embodiments less than about 250 nm, while in selected embodiments preferably less than about 100 nm. The selection of the appropriate size of the particle for a particular application may also depend upon the desired rate of deformation of the coating.

The size of the nanoparticle that may be suitable for different embodiments of the present invention may also depend, in part, on the fabric that is selected for coating. For example, large nanoparticles having an average diameter of greater than about 400 nanometers may be suitable for use in a coating composition for a fabric that has a very high level of breathability, a large void size and a large fiber size. Such a fabric may include one or two layers of a spunbond material having a basis weight in the range of about 1.0 to about 3.0 oz/yd$^2$ (osy) (33.9 gsm to about 102 gsm (grams per square meter)). In embodiments where the coating is to be applied to a material having a smaller fiber size, smaller void size and moderate level of breathability, smaller nanoparticles may be suitable. For example, nanoparticles having an average diameter of less than about 100 nanometers may be suitable for use in a nonwoven fabric which includes a meltblown layer having a basis weight in the range of about 0.2 to about 1.0 osy (6.8 gsm to about 33.9 gsm).

While many different particles are useful in the present invention, silica particles may be particularly suitable for use in the present invention. Additionally, titanium dioxide, alumina, calcium carbonate, zeolite, laponite, magnesium oxide, carbon, copper, silver, polypropylene, polystyrene, and polylactic acid and other particles may also be used in the present invention. The particles in the composition can be of any general shape, and may have shapes such as an oblate or prolate spheroid, ovoid, discs, cylindrical or irregular shapes such as flakes and string-of-pearls.

To investigate the optimum ratio of components, experiments were conducted which varied the amount of silane to dialdehyde, and nanoparticle to silane to dialdehyde. Initial experiments indicated that, while different ratios of components performed effectively, particular ratios demonstrated a somewhat improved performance. More detailed experiments were conducted to evaluate these particular ratios and a desirable manner in which the components could be combined. The results of these more detailed experiments are reported in Table 1. For example, Table 1 delineates the weight ratios of the particle, silane and glutaraldehyde as well as the particle type and size. The average puncture resistance is provided, as well as the standard deviation.

Although many different fabrics may be used in the present invention, all examples in Table 1 were created using the same nonwoven substrate, which is identified in Table 1 as "Base". This base fabric is an SMS nonwoven laminate which is available from Kimberly-Clark Corporation as Kimguard® KC400 Wrap. In each test, a single sheet of 31 gsm SMS was utilized, as opposed to two sheets of SMS adhered together.

TABLE 1

| No. | Reaction Sequence | P:Sil:Glut Weight Ratio | Particle Type & Size (nm) | | Silane | Ave. Puncture Resistance in Newtons | Increase in Average puncture resistance |
|---|---|---|---|---|---|---|---|
| Base | n/a | n/a | n/a | n/a | n/a | 1489 | n/a |
| 1 | Pre | 1:0.25:4 | silica | 15 | APTES | 2131 | 43% |
| 2 | n/a | 0.25:4 | none | n/a | APTES | 2599 | 75% |
| 3 | Post | 1:0.25:4 | silica | 15 | APTES | 2092 | 41% |
| 4 | 50-50 | 1:0.25:4 | silica | 15 | APTES | 1846 | 24% |
| 5 | 50-50 | 2:0.25:4 | silica | 15 | APTES | 1942 | 30% |
| 6 | 50-50 | 1:0.25:4 | silica | 15/400 | APTES | 1876 | 26% |
| 7 | Pre | 1:0.25:8 | silica | 15 | APTES | 2417 | 62% |
| 8 | Pre | 1:1:4 | silica | 15 | APTES | 2312 | 55% |
| 9 | Pre | 1:0.25:4 | silica | 55 | APTES | 2187 | 47% |
| 10 | Post | 1:0.25:4 | silica | 55 | APTES | 2452 | 65% |
| 11 | 50-50 | 1:0.25:4 | silica | 55 | APTES | 2046 | 37% |
| 12 | 50-50 | 2:0.25:4 | silica | 55 | APTES | 1772 | 19% |
| 13 | Pre | 1:0.25:8 | silica | 55 | APTES | 1810 | 22% |
| 14 | Pre | 1:1:4 | silica | 55 | APTES | 1916 | 29% |
| 15 | Pre | 1:0.25:4 | silica | 400 | APTES | 1730 | 16% |
| 16 | Post | 1:0.25:4 | silica | 400 | APTES | 1693 | 14% |
| 17 | 50-50 | 1:0.25:4 | silica | 400 | APTES | 1750 | 18% |
| 18 | 50-50 | 2:0.25:4 | silica | 400 | APTES | 2737 | 84% |
| 19 | 50-50 | 1:0.25:4 | silica | 400/15 | APTES | 1791 | 20% |
| 20 | Pre | 1:0.25:8 | silica | 400 | APTES | 1889 | 27% |
| 21 | Pre | 1:1:4 | Silica | 400 | APTES | 1830 | 23% |
| 22 | Pre | 1:0.25:4 | silica | 15 | TEOS | 2310 | 55% |
| 23 | n/a | 0.25:4 | none | n/a | TEOS | 1824 | 22% |
| 24 | Post | 1:0.25:4 | silica | 15 | TEOS | 2141 | 44% |
| 25 | Post | 1:0.25:4 | silica | 15 | HMDS | 2484 | 67% |
| 26 | Post | 1:0.25:4 | TiO2 | 25 | APTES | 2019 | 36% |
| 27 | Pre | 1:0.25:4 | TiO2 | 25 | APTES | 2568 | 72% |
| 28 | Post | 1:0.25:4 | alumina | 50 | APTES | 2541 | 71% |
| 29 | Pre | 1:0.25:4 | alumina | 50 | APTES | 1893 | 27% |

Puncture testing is commonly used to determine the strength of a material, and was conducted to determine the increase in average puncture resistance that the coatings disclosed herein may provide. Although there are numerous ways to perform puncture testing, the samples of Table 1 were subjected to the following test protocol. A constant rate of extension tensile tester was utilized in combination with a load cell that permits the peak load results to fall between about 10% and about 90% of the capacity of the load cell. The extension tensile tester utilized was the MTS 810, available from MTS Systems Corporation (Research Triangle Park, N.C.). Suitable load cells may be obtained from Instron Corporation (Canton, Mass.) or MTS Systems Corporation or another suitable vendor. A blade having a substantially flat edge was positioned perpendicular to the plane of the nonwoven sample to be tested, and at an angle of 45 degrees with respect to the machine direction of the fabric. As used herein, the terms "machine direction" or "MD" generally refers to the direction in which a material is produced. The term "cross-machine direction" or "CD" refers to the direction perpendicular to the machine direction. The cross-section of the blade which was utilized to puncture the nonwoven fabric had a thickness of 2 mm and a length of 30 mm. The height of the blade (that is, the length of the blade extending upwardly from the fabric) was 20 mm. Testing software, such as, for example, MTS Testworks®, is suitable for determining the required values.

Other tensile tester parameters included a cross-head speed of 800 inches per minute, a break sensitivity of twenty percent, and slack compensation of 10 grams-force. A test specimen of at least about 152.4 mm by 152.4 mm (6 inches by 6 inches) was positioned within the tester and clamped in place using a round circular rubber ring having a diameter of four inches (10 cm). About 20 psi was applied to the circular ring to hold the test specimen in place. For each example, three samples were prepared and tested for puncture resistance. The average of the maximum tensile force for the three samples was calculated and is shown in Table 1 as the Average Puncture Resistance.

For the purposes of the present invention, the average puncture resistance of all samples measured should show an increase over the average puncture resistance of the base fabric. It is not required that the puncture resistance of every individual sample evaluated be greater than the base fabric. The base sample was subjected to puncture resistance testing and had an average puncture resistance (peak load) of 335 lb-f (1491 N). The percent increase in average puncture resistance for all samples is reported in Table 1 and was calculated by subtracting from the average puncture resistance of the sample the average puncture resistance of the base fabric (1489 N), multiplying by 100 and dividing by the average puncture resistance of the base fabric (1489 N).

A unique and unexpected result of the present invention is the change in the sound that is made when the blade punctures the material of the examples, even though all examples remained flexible, drapable and breathable. In each of the samples of the present invention shown in Table 1, a distinct "pop" was heard when the blade penetrated the sample. This sound was not heard on the base control sample. Without wishing to be bound to any particular theory, it is believed that the loud "pop" is caused by the coated fabric being able to absorb more energy prior to a catastrophic break. The opening formed in the coated fabric is a clean cut. In contrast, the opening formed in the base fabric is fuzzy. It is believed that the base fabric opening is formed by the elongation of individual fibers before failure.

The examples also investigate when the particles should be added during the preparation of the coating composition. Specifically, experiments were conducted where the nanoparticles were added at the beginning of the reaction ("Pre"), at the end of the reaction ("Post"), and where half the particles were added at the beginning and half the particles added at the end of the reaction (50-50). While not wishing to be held to a particular theory, it is believed that when the nanoparticles are added to the silane and glutaraldehyde at the beginning of the reaction, the nanoparticles appear to be better incorporated into the composition. When the nanoparticles are added after the reaction of the silane and glutaraldehyde, it is thought that the nanoparticles link the ends of the silane/glutaraldehyde mixture into a network having some cross-linking. This cross-linking may occur at the beginning of the reaction or at the end of the synthesis if the particles are sufficiently small to diffuse into the gel.

Looking at example 1 as described in Table 1, the coating that was applied to the SMS material was a 1:0.25:4 weight ratio of 15 nm silica particles, APTES and glutaraldehyde, respectively. To produce example 1, 0.25 grams of APTES and 20 ml of ethanol were stirred in a 50 ml round bottomed flask with a magnetic stir bar at room temperature for about 20 minutes. This solution was then poured into one gram of silica nanoparticles and the mixture was stirred for 20 minutes at ambient temperature. The mixture was then added to 20 ml of a 50% by weight solution of glutaraldehyde in deionized water and stirred at room temperature for about 60 minutes. This reaction sequence is referred to as "Pre" in Table 1.

Each of three 6 inch by 6 inch squares of SMS was separately placed into this mixture and permitted to soak for at least one to about ten seconds. The square of SMS was then passed through an Atlas Laboratory Wringer (model number LW-824, which is available from the Atlas Electric Company, Chicago Ill.) at a nip pressure of 6.8 kg and at the wringer's standard speed. Each square of SMS was air-dried in a fume hood at ambient temperature for at least about five hours and then subjected to puncture testing according to the methodology described above. The coating increased the average puncture resistance of the base fabric by 43%.

Figure 2:
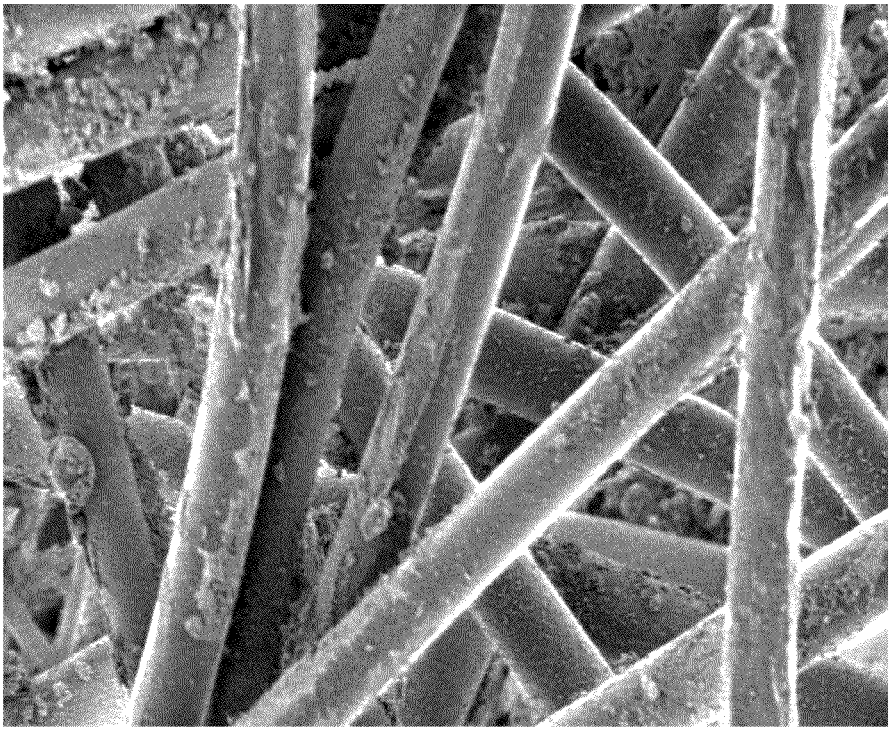
FIG. 2 is a photomicrograph of a fabric formed in accordance with one embodiment of the present invention.

A coated fiber of an embodiment of the present invention is shown in the photomicrograph of FIG. 1. While not all fibers are required to be fully coated, all the visible exterior surface area of the fiber shown in FIG. 1 is coated and additional coating is adhered to the fiber in clumps. FIG. 2 shows a plurality of such fibers in a nonwoven web, and demonstrates that the coating composition permits the fabric to retain a significant portion of its original breathability by adhering to fibers rather than filling in the interstices in the nonwoven web. In preferred embodiments, at least about 50% of the fiber is coated with the coating composition, although other embodiments may include fibers which have at least about 60% of their visible exterior surface coated with the coating composition. Still other embodiments may include fibers having at least about 75% of their visible exterior surface coated with the coating composition, or in particular embodiments may have at least about 90% of their visible exterior surface coated. It is not necessary that the entire exterior surface of the fiber be coated with the coating composition, as synergies may be obtained by the mere layering of fibers in the nonwoven web. Similarly, additional synergies may be obtained by the layering of one or more nonwovens which have been treated with the coating of the present invention.

To approximate the percentage area of the particle which is available or free of coating from a photomicrograph, the bright areas of the backscattered electron image are detected and isolated so that the total exposed area of the particles can be measured. An outline may be created which estimates the perimeter of the entire fiber, some of which may be covered by the coating composition. Standard image analysis software, such as IMIX by Princeton Gamma Tech, may be used to calculate the areas and determine the percent area of the visible exterior surface of the fiber which is coated by coating composition by dividing the area of the fiber which is coated with the coating composition by the estimated area of the fiber and multiplying by 100. While this process is inexact, it can provide a rough estimate of the percent area of the fiber which is coated with the coating composition.

In example 2, APTES was added to glutaraldehyde in a 0.25:4, ratio using the mixing, application and testing methodology described above, without the addition of particles. The increase in average puncture resistance was 75%. This example demonstrates that glutaraldehyde and APTES alone may form a sufficiently strong bond to improve the average puncture resistance of the base nonwoven. Similarly, TEOS was added to glutaraldehyde in a ratio of 0.25:4 by weight (example 23) and provided an increase in average puncture resistance of 22%. While not wishing to be held to a particular theory, the substantial difference in average puncture resistance between these two examples may indicate that aminofunctional silanes may provide a greater improvement in the average puncture resistance than other silanes.

The coating composition of example 3 was prepared using a 1:0.25:4 weight ratio of silica particles having an average diameter of about 15 nm, APTES and glutaraldehyde. While the process of producing the exemplary coating composition described above is similar to the process by which example 3 was prepared, it is of note that the nanoparticles were added "post", that is, after the APTES and glutaraldehyde were combined. The increase in average puncture resistance was 41%.

Example 4 was prepared using a ratio of 1:0.25:4 by weight of 15 nm silica particles, APTES and glutaraldehyde. Half of the silica nanoparticles were added at the beginning of the reaction (as in the "Pre" reaction sequence of example 1) and half of the silica nanoparticles were added at the end of the reaction (as in the "Post" reaction sequence of example 3). This reaction sequence has been designated "50-50" in Table 1, indicating that 50% of the particles by weight were added during the reaction sequence and 50% of the particles by weight were added at the end of the reaction sequence. The increase in average puncture resistance for example 4 was 24%. Similarly, example 5 was prepared using a 50-50 process with silica particles having an average diameter of about 15 nm, APTES and glutaraldehyde in a ratio by weight of 2:0.25:4, respectively. The increase in average puncture resistance was 30%.

Example 6 was prepared using a ratio of 1:0.25:4 by weight of silica particles, APTES and glutaraldehyde. Half of the silica nanoparticles by weight had an average diameter of 15 nm, and these nanoparticles were added at the beginning of the reaction. The remaining half of the silica nanoparticles by weight had an average diameter of 400 nm, and these nanoparticles were added at the end of the reaction. The increase in average puncture resistance was 26%. Similarly, example 19 also utilized silica nanoparticles in which half of the nanoparticles by weight had an average diameter of 400 nm and the remaining nanoparticles had an average diameter of 15 nm. In example 19, the 400 nm silica nanoparticles were added earlier in the process while the 15 nm silica nanoparticles were added at the end of the process. The coating of example 19 increased the average puncture resistance of the SMS by 20%.

In examples 7 and 8, the 15 nm silica particles were added to APTES and glutaraldehyde in the same manner as was used for example 1. In contrast to example 1, the weight ratio for example 7 was 1:0.25:8 and 1:1:4 for example 8. The increase in average puncture resistance provided by examples 7 and 8 were 62% and 55%, respectively.

Examples 9 through 14 were prepared using APTES, glutaraldehyde and silica particles having an average diameter of about 55 nm, although the reaction sequence and weight ratios for the examples varied. The increase in average puncture resistance varied from 19% to 65% for these samples. From these examples, the increase in size of the nanoparticles from 15 to 55 nm did not appear to impact the function of the coating on the SMS. It is possible that, for other substrates, a similar increase in size of the nanoparticles may impact the increase in average puncture resistance obtained.

Examples 15 through 18, 20 and 21 were formed from APTES, glutaraldehyde and 400 nm silica particles, with varying reaction sequences and weight ratios. The increase in average puncture resistance varied from 14% to 84%. This level of variation may be due in part to the size of the silica nanoparticles with respect to the voids in the meltblown layer of the SMS material.

Examples 22, 24 and 25 investigate the use of silica nanoparticles with TEOS and HMDS rather than APTES. In examples 22 and 24, the coating composition with TEOS and nanoparticles functioned well by providing increases in average puncture resistance of 55% and 44%, respectively. Example 25 utilized HMDS as the silane, and increased the average puncture resistance of the base material by 67%.

Examples 26 and 27 evaluated the use of titanium dioxide as the nanoparticle of the composition, with increases in average puncture resistance of 36% and 72%. Similarly, examples 28 and 29 evaluated the use of alumina as the nanoparticle of the composition, with increases in average puncture resistance of 71% and 27%.

The examples shown demonstrate that the coating composition of the present invention is able to increase the average puncture resistance of a nonwoven fabric.

While the invention has been described in detail with respect to the specific embodiments thereof, it will be appreciated that those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A nonwoven fabric comprising:

a plurality of fibers having an exterior surface;

a coating upon the exterior surface of said fibers;

the coating comprising the cross-linked reaction product of an amino-functionalized silane, a dialdehyde and silica nanoparticles wherein (i) the ratio of parts dialdehyde to the amino-functionalized silane is at least 2:1; (ii) the nanoparticles have an average diameter less than 500 nm, (iii) the weight ratio of dialdehyde to the silica nanoparticles is at least 2:1, and (iv) the coating composition has a basis weight of between 0.5 $g/m^2$ and 6 $g/m^2$.

2. The nonwoven fabric of claim 1, wherein the particles have an average diameter less than about 250 nanometers.

3. The nonwoven fabric of claim 1, wherein the particles have an average diameter less than about 150 nanometers.

4. The fabric of claim 1, wherein the nonwoven fabric is a laminate that includes a spunbond layer and a meltblown layer.

5. The nonwoven fabric of claim 1, wherein the exterior surface of the fibers comprising the nonwoven web are corona treated.

6. The nonwoven fabric of claim 1, wherein the dialdehyde comprises glutaraldehyde.

7. The nonwoven fabric of claim 1, wherein the average puncture resistance of the fabric is increased by at least about 25%.

8. The nonwoven fabric of claim 1, wherein at least 50% of the visible exterior surface of the fiber is coated with the coating composition.

9. The nonwoven fabric of claim 1 wherein the silane is selected from the group comprising tetraethoxysilane, aminopropyltriethoxysilane or hexamethyldisilazane.

10. The nonwoven fabric of claim 1 wherein the silane is hexamethyldisilazane.

11. The nonwoven fabric of claim 9 wherein the dialdehyde is glutaraldehyde.

12. The nonwoven fabric of claim 9, wherein the average puncture resistance of the fabric is increased by at least about 25%.

13. The nonwoven fabric of claim 9 wherein the coating composition covers at least about 50% of the visible exterior surface of the plurality of coated fibers.

14. The nonwoven fabric of claim 12 wherein the nonwoven fabric having coated fibers is selected from the group consisting of meltblown webs, spunbond webs, and carded webs.

15. The nonwoven fabric of claim 7 wherein the nonwoven fabric comprises a spunbond-meltblown-spunbond laminate.

16. The nonwoven fabric of claim 7 wherein at least about 75% of the visible exterior surface of the plurality of coated fibers is coated with the coating composition.

17. The nonwoven web of claim 1 wherein the amino-functionalized silane is selected from the group consisting of $NH_2CH_2CH_2CH_2Si(OC_2H_5)_3$; hexamethyldisilazane; heptamethyldisilazane; 3-aminopropyltriethoxysilane; bis[(3-triethoxysilyl)propyl]amine; 3-aminopropyltrimethoxysilane; 3-aminopropylmethyldiethoxysilane; 3-aminopropylmethyldimethoxysilane; aminoethylaminopropyltrimethoxysilane; aminoethylaminopropyltriethoxysilane; aminoethylaminopropylmethyldimethoxysilane; aminoethylaminopropylmethyldiethoxysilane; aminoethylaminomethyltriethoxysilane; aminoethylaminomethylmethyldiethoxysilane; diethylenetriaminopropyltrimethoxysilane; diethylenetriaminopropyltriethoxysilane; diethylenetriaminopropylmethyldimethoxysilane; diethylenetriaminopropylmethyldiethoxysilane; diethylenetriaminomethylmethyldiethoxysilane; (n-phenylamino)methyltrimethoxysilane; (n-phenylamino)methyltriethoxysilane; (n-phenylamino)methylmethyldimethoxysilane; (n-phenylamino)methylmethyldiethoxysilane; 3-(n-phenylamino)propyltrimethoxysilane; 3-(n-phenylamino)propyltriethoxysilane; 3-(n-phenylamino)propylmethyldimethoxysilane; 3-(n-phenylamino)propylmethyldiethoxysilane; diethylaminomethyltriethoxysilane; diethylaminomethyldiethoxysilane; diethylaminomethyltrimethoxysilane; diethylaminopropyltrimethoxysilane; diethylaminopropylmethyldimethoxysilane; diethylaminopropylmethyldiethoxysilane and n-(n-butyl)-3-aminopropyltrimethoxysilane.

18. The nonwoven web of claim 3 wherein the dialdehyde is selected from the group consisting of alkyl and aromatic dialdehydes.

19. A protective garment comprising the nonwoven fabric of claim 1.

20. A sterilization wrap comprising the nonwoven fabric of claim 1.

* * * * *